US005573350A

United States Patent [19]

Stegall

[11] Patent Number: 5,573,350

[45] Date of Patent: Nov. 12, 1996

[54] METHOD FOR CUTTING COMPLEXLY SHAPED FOAMED PLASTIC BODIES FROM A WORKPIECE AND FOAM BODY PRODUCTS

[75] Inventor: Lannie L. Stegall, Versailles, Ky.

[73] Assignee: ABT, Inc., Troutman, N.C.

[21] Appl. No.: 274,627

[22] Filed: Jul. 13, 1994

[51] Int. Cl.[6] ..... E02B 5/00

[52] U.S. Cl. ..... 405/119; 249/11; 404/2; 404/4; 405/118; 405/121

[58] Field of Search ..... 405/118–121, 124–125; 404/2–4, 25, 26; 249/1, 3–9, 207–209

[56] References Cited

U.S. PATENT DOCUMENTS

| | | | |
|---|---|---|---|
| 3,333,494 | 8/1967 | Smith . | |
| 3,568,455 | 12/1968 | McLaughlin et al. . | |
| 3,786,701 | 1/1974 | Ludwig . | |
| 4,018,116 | 4/1977 | Treffner et al. . | |
| 4,077,301 | 3/1978 | Brahm . | |
| 4,393,450 | 7/1983 | Jerard . | |
| 4,683,791 | 8/1987 | Demont . | |
| 4,957,268 | 9/1990 | Picollo et al. . | |
| 4,993,877 | 2/1991 | Beamer . | |
| 4,993,878 | 2/1991 | Beamer | 405/118 X |
| 5,000,621 | 3/1991 | Beamer . | |
| 5,326,189 | 7/1994 | Beamer | 405/118 X |

FOREIGN PATENT DOCUMENTS

WO90/11405 3/1990 WIPO .

OTHER PUBLICATIONS

*Trench Former System,* brochure by ABT, Inc. TF Jun. 1992.
*Trench Former System,* brochure by ABT, Inc. TF Jun. 1992.
EconoDrain™ by Multi/Drain Brochure (1992).
EconoDrain™ by MultiDrain (02725/Mun—BuyLine 7497).

*Primary Examiner*—Dennis L. Taylor
*Attorney, Agent, or Firm*—Bell, Seltzer, Park & Gibson, P.A.

[57] ABSTRACT

A method for cutting first and second complementary foamed plastic bodies of a predetermined shape from a single workpiece includes the step of moving a linear cutting element through the workpiece. The linear cutting element, such as a heated wire, is moved through the workpiece to form a first surface which forms a portion of the predetermined shape of the first and second foamed plastic bodies. The workpiece is thereafter shifted in position relative to the linear cutting element and the linear cutting element is again moved through the shifted workpiece to form a second surface. Due to the shifting of the workpiece, the first surface is sloped relative to the second surface. The first and second foamed plastic bodies are preferably first and second trench forms defining the shapes of different sections of a trench drain which has a continuously sloped bottom surface.

4 Claims, 6 Drawing Sheets

METHOD FOR CUTTING COMPLEXLY SHAPED FOAMED PLASTIC BODIES FROM A WORKPIECE AND FOAM BODY PRODUCTS

FIELD OF THE INVENTION

The present invention relates to a method for cutting two or more foamed plastic bodies of complex shape from a workpiece. The invention also relates to products in the form of a set of foamed plastic bodies having complex shapes that can be assembled together into a single article such as a single form.

BACKGROUND OF THE INVENTION

Shaped bodies of lightweight, foamed plastic, such as 'styrofoam' are formed by various known methods including molding, extrusion, and the like. The formation of a foamed plastic body of complex exterior shape normally requires a batch molding process, such as injection molding, or a cutting process wherein the shaped body is cut from a relatively large blank or billet. Because molds such as injection molds, rotational molds and the like, require a substantial investment, the molding processes are normally used only when the molded parts are manufactured in extremely large quantities, and when the number of different molded bodies or parts is limited. The cutting process, on the other hand, is more flexible and can be used to produce foamed bodies of varying shapes and sizes.

For example, where individual lots of shaped, foamed plastic bodies are manufactured in response to varying end use specifications; or where numerous large lots of plastic bodies must be supplied to meet many different specifications, the cutting method can allow such production while minimizing capital investment. However cutting processes also generate substantial waste as portions of the workpiece blank or billet are removed to form the shaped body. Although the scrap is discarded, the material cost associated with the scrap increases the ultimate cost of the foamed plastic body.

Because foamed plastic bodies can have easily deformable exterior surfaces, protective packaging is often needed during shipping of the finished foamed articles. In some instances, plastic foam scrap generated during the cutting operation has been used to form a portion of such protective packaging because scrap pieces have a shape complementary to portions of the exterior of the cut article. However this is only practical with relatively simple shapes and when only a small number of cutting steps are used because complex shapes and multi-step cutting processes generate numerous scrap pieces of differing shapes and sizes that cannot readily be put back together.

Recently, foamed plastic bodies have been used with substantial commercial success as forms for the on-site formation and installation of drainage trenches as disclosed in U.S. patent application Ser. No. 07/768,610 entitled "Trench Forming Assembly and Method" of Lannie L. Stegall. In accord with a preferred method disclosed therein, a plurality of elongate foamed plastic bodies of a predetermined shape are aligned in end to end contact within a preformed ditch. A hardenable trench forming composition, such as concrete, is poured around the aligned form bodies. The hardenable composition is allowed to set around the form bodies and thereafter the form bodies are removed to produce a unitary drainage trench having the shape of the form bodies.

In the above-identified method, the foamed plastic form bodies must be cut according to relatively accurate tolerances so that the aligned form bodies will match at their abutting ends. Thus the cross-sectional profile of each individual form body, particularly at its ends, is preferably identical to the profile of the abutting form body.

In many instances, drainage trench specifications require a sloped bottom surface along the length of the trench to facilitate drainage. Accordingly, the foamed plastic bodies used to form the drainage trench must also have correspondingly sloped bottom surfaces. In such cases the profile or cross-section of each form body must be taller at one end and shorter at the other, but the widths must be identical. The end profiles of adjacent, aligned form bodies must also match closely so that the drainage trench will have a relatively continuous sloping bottom surface. This has been achieved in the past typically by manually aligning identical form bodies; marking a continuous cut line of a desired slope along the aligned bodies and then cutting the bottoms of the individual form bodies along the cut mark.

Foamed plastic bodies of predetermined shapes adapted for assembly into larger bodies are also used in numerous other instances throughout commerce, for example to provide artificially sloped surfaces for sporting activities such as artificial pitcher's mounds for baseball; and for other end uses such as sloped surfaces for roofing surfaces on buildings. In these and similar uses, the individual foamed plastic bodies must be precisely shaped so that they can be assembled to form the desired final larger shape. However, when a cutting processes is used to shape the individual bodies, a custom operation is often required. This precision shaping and matching of surfaces can be labor intensive and costly, and as indicated above, often generates large amounts of waste.

SUMMARY OF THE INVENTION

The invention provides an improved method and apparatus for cutting two or more foamed plastic bodies having complex shapes from a workpiece. In preferred embodiments, the method of the invention is used to cut two or more complementary foamed plastic bodies of a predetermined shape from a single workpiece. The method of the invention can substantially reduce the amount of scrap generated during a cutting operation, particularly when it is used to cut plural complementary bodies.

The method of the invention is conducted using a linear cutting element on a workpiece such as a foamed plastic billet. The complexly shaped cut bodies provided by the cutting method of the invention have at least two different cut surfaces defining all or a portion of the surface of the cut body wherein one of the cut surfaces extends along the body in a first predetermined angular relationship to a predetermined axis of the body, and the other surface extends along the body in a different predetermined angular relationship to the predetermined axis of the body. The method is conducted by moving the linear cutting element, which is preferably a hot wire, through the workpiece while the workpiece is maintained in a first axial orientation with respect to the linear cutting element to form a first cut surface which defines at least a portion of the surface of both the first and second foamed plastic bodies. The workpiece is then shifted to a second axial orientation relative to the linear cutting element and the linear cutting element is then moved through the workpiece to form a second cut surface which defines at least a portion of the surface of at least one of the first and second cut bodies and which is positioned between the two bodies. Preferably two foamed plastic bodies which are matching along one or more surfaces and complementary along another surface are cut from a single workpiece. In such preferred embodiments, the first cut surface defines a matching portion of each of the plastic bodies. The complementary surfaces on the two plastic bodies are formed adjacent or closely spaced in facing relationship to each other and are formed in the second cutting step which can be carried out by making only a single cut or multiple cuts.

In a preferred embodiment, the foamed plastic bodies are elongate form bodies for forming a trench drain having a sloping bottom surface. In this embodiment, the cutting method forms surfaces defining at least two opposed side surfaces and a bottom surface for each of the two forms bodies cut from the workpiece. Each elongate form body has a profile transverse to its longitudinal axis wherein the opposed side surfaces of the form body each extend along the length of the form body in parallel relation to its longitudinal axis. The bottom surfaces of the two form bodies each extend in non-parallel relation to the longitudinal axis of their respective form bodies so that each of the form bodies has a sloping bottom surface. The bottom surfaces of the two form bodies are preferably sloped equally relative to their respective top surfaces so that they can be used to produce a drainage trench having a constantly sloped bottom surface. Each of the form bodies thus has a height which is shorter at one end that at the other end.

Although cutting methods of the prior art produce a substantial amount of waste material when used to produce form bodies with sloped surfaces, particularly at the narrower end of the form body, in the present invention such waste can be avoided. This is accomplished by cutting the two bodies from a single elongate workpiece and by forming the bottom surfaces of the two forms as complementary surfaces adjacent or closely spaced, in facing relationship to each other, from an interior portion of the workpiece. Thus, during the cutting operation, the sloping bottom surfaces of the form bodies are cut such that the shorter end of one form body is at the same end of the workpiece as the taller end of the other form body. The bottom surfaces of the two form bodies also extend in facing relationship substantially along the entire length of the workpiece so that at the other end of the workpiece the taller end of the first form body faces the shorter end of the second form body. This allows generation of waste to be minimized at both ends of the workpiece.

According to another preferred embodiment of the present invention, the linear cutting element is also preferably moved through an interior portion of first and second complementary foamed plastic bodies to form an interior surface within each body. When this method is used to cut drainage form bodies, the interior surface defines a pair of slots extending inwardly into both the first and second forms from their respective bottom surfaces.

In preferred embodiments of the invention, drive means, responsive to the control means, moves the linear cutting element through the workpiece to cut first and second complementary foamed plastic bodies from a single workpiece. In one embodiment, the control means includes a set of instructions that defines the predetermined shape of both the first and second foamed plastic bodies. The instructions can be in the form of a template which displays, in transverse cross-section, a pattern defining the shapes of the two form bodies. In this embodiment, the linear cutting element is moved through the workpiece along a path corresponding to a first portion of the predetermined pattern to produce a first surface. The workpiece is thereafter shifted relative to the linear cutting element and the linear cutting element is again moved through the workpiece along another path corresponding to a second portion of the predetermined pattern. The linear cutting element is preferably moved in response to the predetermined pattern displayed by the template by electronically tracking the predetermined shape displayed by the template.

In one product embodiment of the invention, pairs of elongate form bodies having complementary surfaces and matching surfaces are cut from an elongate workpiece such that all of the exterior longitudinal surfaces of the bodies are cut from portions of the interior of the workpiece. Preferably, the cuts forming the longitudinal cut surfaces of the form bodies are joined to the exterior of the workpiece by no more than about four cuts. The scrap formed in cutting the longitudinal surfaces can then be used as a protective container for shipping the form bodies.

In another product embodiment of the invention, a plurality of elongate foamed plastic bodies of predetermined shapes adapted for assembly into an elongate drain form are provided. Each of the form bodies has a substantially identical length and width, and the profiles of the sidewall surfaces are substantially matching. Each of the foamed plastic bodies also have correspondingly sloped bottom surfaces such that the longitudinal profile of each form body is taller at one end and shorter at the other. The end profiles of the set of form bodies vary in height from a predetermined tallest height to a predetermined shortest height, and, with the exception of the tallest and the shortest end profiles, each end profile is substantially matching in height with an end profile on another form body. In addition, the heights of each of the taller and shorter end profiles, respectively, on each form body are complementary to the heights of the shorter and taller end profiles, respectively, of another of the form bodies such that the sums of the heights of all of the complementary end profiles are the same. These sets of form bodies can be used to provide a retail supply of standard sized form bodies that can be assembled to form drainage trenches of varying overall lengths since a customer can purchase only a few of the matching form bodies to form a short drain having a sloping surface, or a complete set of the form bodies to form a longer drain having a sloping surface. The retailer can reorder complete sets of the form bodies or only partial form body sets. In either case the form bodies of one set can be used with form bodies from another set to form short or long drains with sloping surfaces.

BRIEF DESCRIPTION OF THE DRAWINGS

In the drawings which form a portion of the original disclosure of the invention.

DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
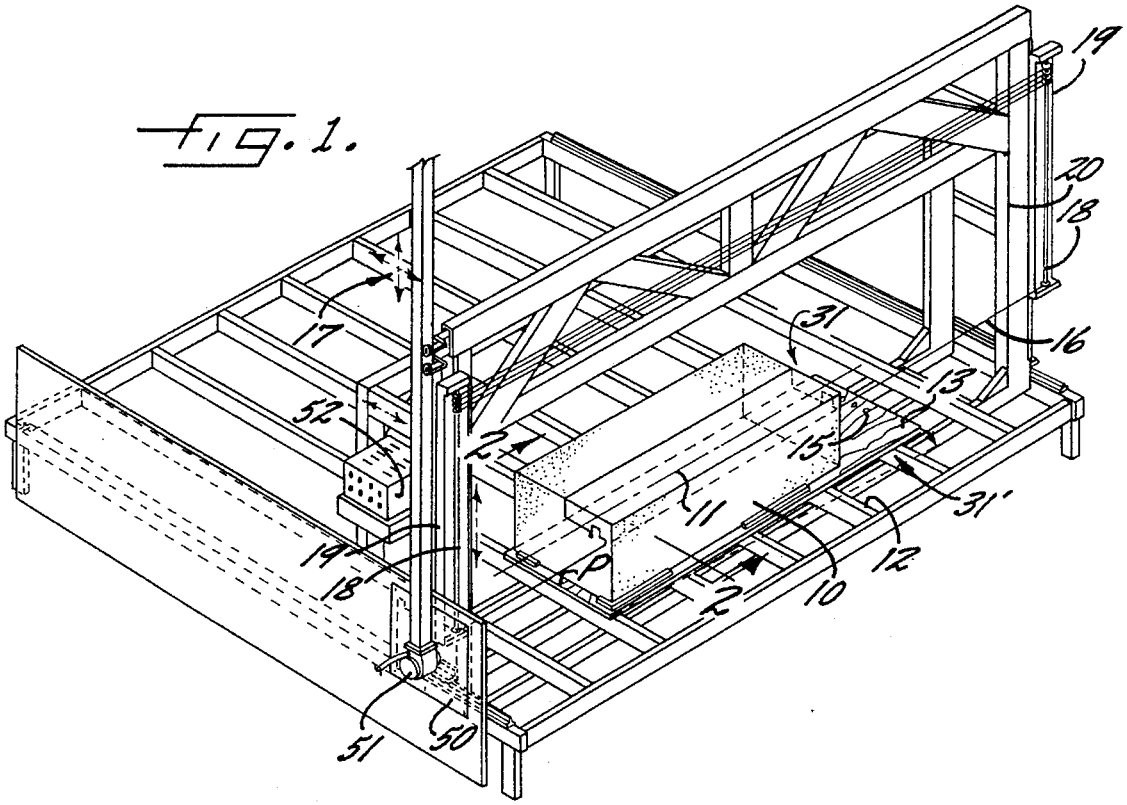
FIG. 1 is a perspective view of a foamed plastic workpiece mounted on a cutting table.
Figure 2:
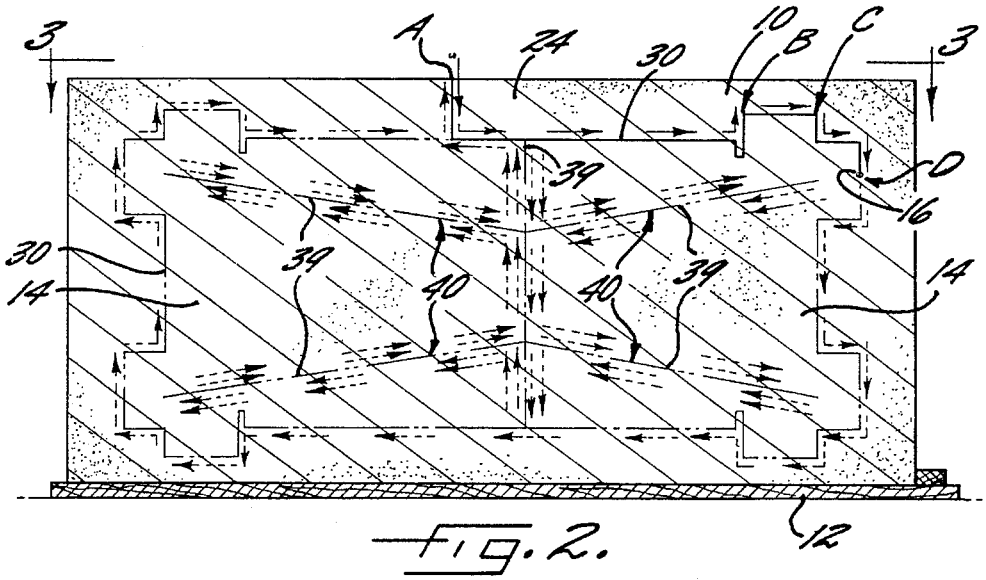
FIG. 2 is a longitudinally transverse cross-sectional view of the workpiece illustrating the movement of the linear cutting element through the workpiece along a path to form portions of the exterior surfaces of each of two bodies which are parallel to the longitudinal axis of the workpiece.

Referring now to FIG. 1, an elongate foamed plastic workpiece be having a longitudinal axis 11 is shown mounted in a fixed position on a cutting table 12. While the workpiece 10 may be formed of any foamed plastic material, the workpiece be is typically formed of expanded polystyrene. As illustrated, the workpiece 10 is positioned in a fixed position on a cutting table 12 such that the longitudinal axis 11 of the workpiece is oriented in a direction extending across the width of the table 12. The workpiece 10 is shown with a longitudinal cut therethrough defining portions of the exterior surface of complementary first and second bodies 14 (FIG. 2). A linear cutting element 16 is shown partially within the workpiece be as it cuts through the workpiece.

The linear cutting element 16 is moveable along two axes 17 which are mutually transverse and are also each transverse to the axial orientation of the linear cutting element 16. However the linear cutting element 16 cannot be moved in the direction of its own length and is thus always maintained in an axial orientation extending transversely across the table 12. Thus, a predetermined angular relationship is maintained between the axis of the linear cutting element 16 and one axis of the fixed workpiece 10 once the workpiece has been fixedly positioned on the worktable 12. In the arrangement illustrated in FIG. 1, it will be apparent that the workpiece 10 is fixed to the table 12 with its longitudinal axis 11 parallel to the linear cutting element 16.

The linear cutting element 16 is typically a wire which extends across the cutting table 12. The wire is normally maintained in a heated condition sufficient to quickly melt foamed plastic material which it contacts and thereby form a cut surface as it is moved through the foamed plastic workpiece. The two ends of the linear cutting element 16 are connected to horizontally opposed first and second support members 18. The opposed support members 18 are mounted for simultaneous vertical movement on a pair of vertical support arms 19 which, in turn, are mounted in fixed relationship to each other for simultaneous controlled horizontal movement along a pair of parallel guide tracks 20 that are positioned on opposed sides of the cutting table 12.

The controlled vertical movement of the support members 18 and the controlled horizontal movement of the of vertical support arms 19, thus provide controlled movement of cutting element 16 relative to the surface of the cutting table 12 along the two perpendicular axes 17, one of which extends upwardly from the table, and the other of which extends along the length thereof. Horizontal movement of the vertical support arms 19, and vertical movement of the support members 18 is effected by a conventional drive means (not shown) which operates in response to control means such as manual control, microprocessor control (as hereinafter described), or in any other manner known to those skilled in the art.

FIG. 2 illustrates in longitudinally transverse cross-section a portion of a cutting path through workpiece 10 for cutting portions of surfaces defining complementary matching drainage form bodies. Initially, the linear cutting element 16 is moved downwardly into the workpiece 10 at point A. Once the cutting element 16 enters into the workpiece 10, it extends fully through the workpiece 10 along its length and outwardly of its opposed end faces (FIG. 1). The linear cutting element 16 is first moved along the closed peripheral path indicated in by the single arrows in FIG. 2 through the interior of the workpiece 10 to form a first surface 30.

Figure 3:
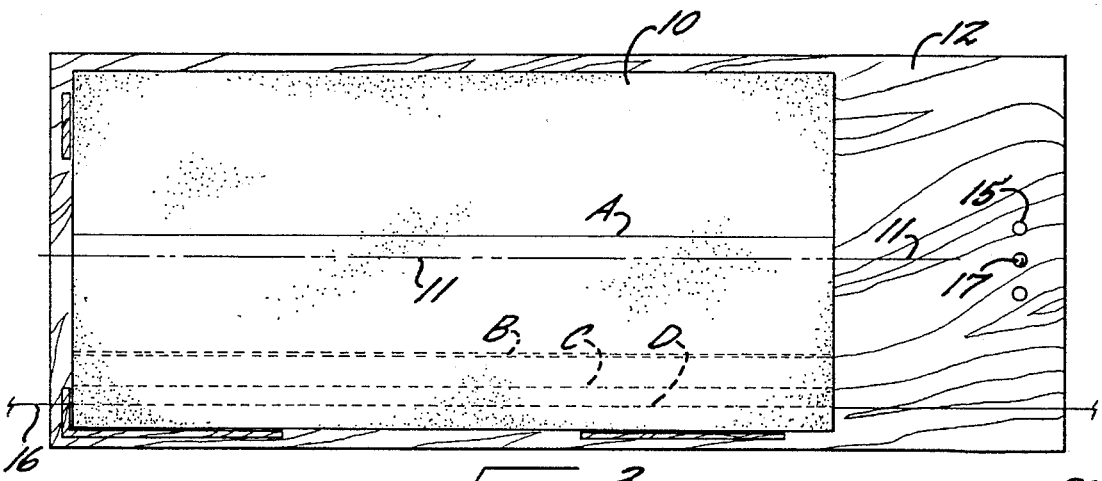
FIG. 3 is a top plan view of the workpiece of FIGS. 1 and 2 illustrating the portion of the surface formed by moving the linear cutting element from point A to point B along the path shown in FIG. 2.

Various positions, B, C, and D, of the linear cutting element as it moves along the first portion of the path forming the surface 30 are specifically identified in FIG. 2 and are also illustrated in FIG. 3 in top plan view. As will be appreciated from a consideration of FIGS. 2 and 3, the cut surface is formed in parallel with the longitudinal axis 11 of the workpiece. Stated differently, cut surface 30 defines a plurality of contiguous, mutually parallel lines, which are each aligned in parallel with the longitudinal axis 11 of the workpiece 10.

Figure 4:
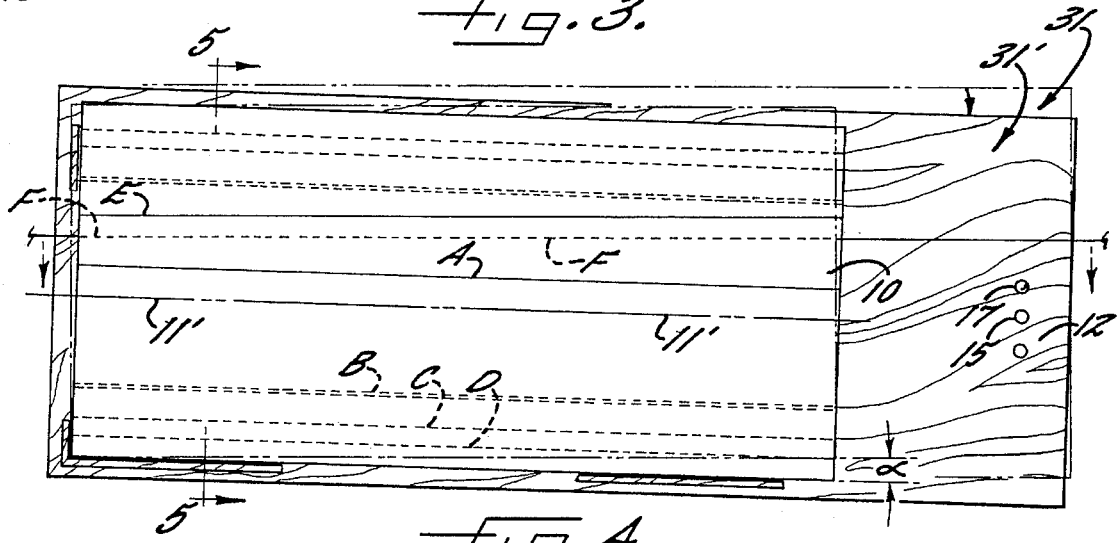
FIG. 4 is a top plan view of the workpiece, following shifting thereof and illustrates the angular relationship between; (i) the linear cutting element; and (ii) the longitudinal axis of the workpiece and portions of the first surface formed parallel to the longitudinal axis of the workpiece.

Once the first surface 30 has been formed, the workpiece 10 is shifted from a first position 31 to a new position 31' shown in FIG. 4, in which the workpiece is oriented in a different angular orientation relative to the cutting table 12 and to the axial orientation of the cutting wire 16. Thus the longitudinal axis 11 of the workpiece 10 is also shifted to a new orientation 11' relative to the linear cutting element 16. As best seen in FIG. 4, the angle $\alpha$ defined between the longitudinal axis of the elongate workpiece 10 and the linear cutting element 16 can be controllably varied by the shifting of the workpiece 10 within a range of from 1° to 89°.

In the embodiment illustrated in FIGS. 1, 3 and 4, the workpiece 10 is supported by a support platform 13. The support platform 13 is mounted to the table 12 and is adapted to rotate about pivot P relative to the table. The support platform 13 may define a plurality of apertures 15 for receiving a projection 17 extending upwardly from the table 12. By rotating the support platform 13 and the workpiece 10 such that the projection 17 engages different ones of the apertures 15, the support platform 13 and the workpiece 10 are rotated predetermined angular amounts relative to the table 12.

While a support platform 13 defining a plurality of apertures 15 for facilitating rotation of the workpiece 10 by predetermined angular amounts is illustrated, other methods of rotating the workpiece relative to the linear cutting element 16 may be employed. For example, the workpiece 10 may be directly supported by the table 12 and may be rotated by hand relative to the table.

In preferred embodiments of the invention for cutting drainage form bodies, the linear cutting element 16 is substantially parallel to the longitudinal axis of the elongate workpiece 10 during the formation of the first surface 30 as discussed above. Subsequently, after the workpiece 10 has been shifted, the linear cutting element 16 is oblique to the longitudinal axis of the elongate workpiece 10.

Prior to and during the shifting step, the linear cutting element 16 is preferably removed from the interior of the foamed plastic workpiece 10 to prevent excessive melting of the foamed plastic material during the shifting of the workpiece 10. It is to be noted that the removal step is not absolutely required and thus the linear cutting element 16 may remain within the interior of the foamed plastic workpiece 10 while it is shifted without departing from the spirit and scope of the present invention. However the cutting element 16 is preferably removed during the cutting step, and once the workpiece 10 has been shifted, the linear cutting element 16 is then reinserted into the workpiece 10, at a desired location such as at point E as illustrated in FIG. 5.

Figure 5:
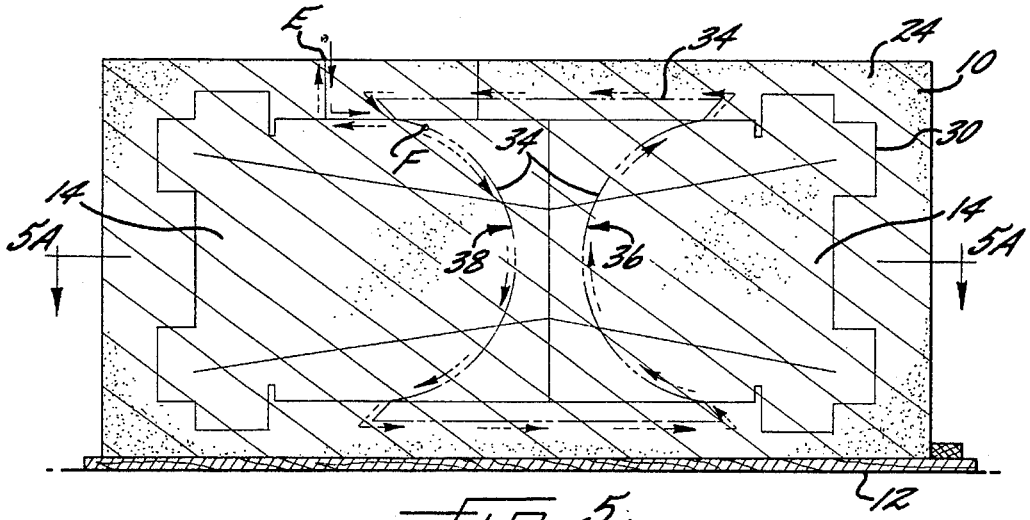
FIG. 5 is a longitudinally transverse cross-sectional view of the workpiece illustrating the movement of the linear cutting element to form second cut surfaces between two cut bodies which define complementary sloping bottom surfaces of matching form bodies.

The linear cutting element 16 is again moved through the interior of the workpiece 10 along a second path in the direction of the arrows shown by the dashed line illustrated in FIG. 5 to form a second surface 34. At least those portions 36 and 38 of the second surface 34 formed by vertical movement of the cutting element 16 through the workpiece 10 will extend in non-parallel relation to the longitudinal axis 11 of the workpiece 10 since the cutting element 16 is not aligned parallel to the orientation 11' of the longitudinal axis of the workpiece in the shifted position 31' during the second cutting step. Thus the cut surface 34 defines a series of contiguous, mutually parallel lines that extend in non-parallel relation to the longitudinal axis 11 of the workpiece. This can be seen in FIG. 4 by a comparison of the orientation of the cutting positions E and F of element 16 with the shifted orientation 11' of the longitudinal axis of the workpiece in the shifted position 31'. The non-parallel alignment of the cut surfaces 36 and 38 with the longitudinal axis of the workpiece can also be seen in FIG. 5A.

Figure 5A:
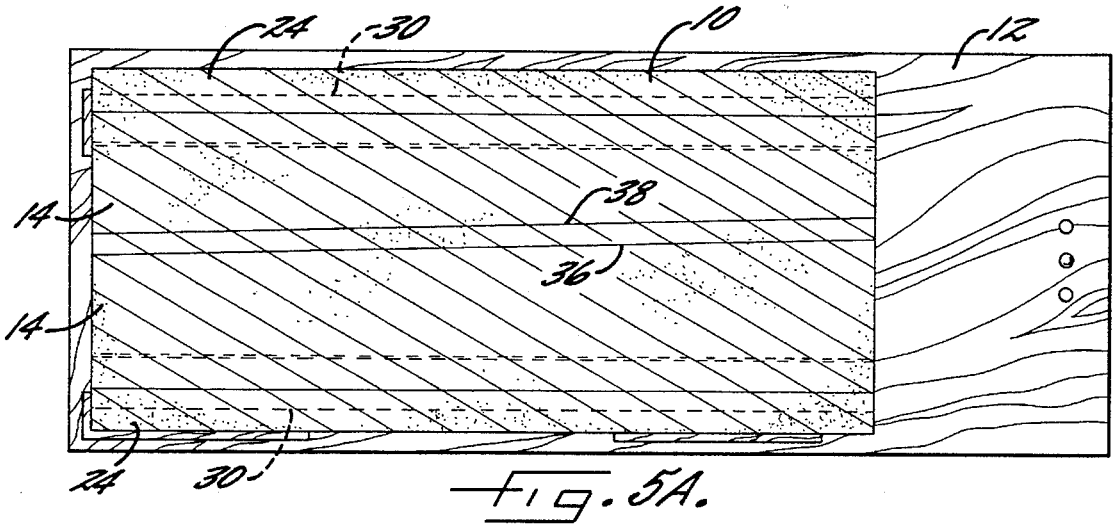
FIG. 5A is a cross-sectional view taken along line 5A—5A of FIG. 5 and illustrates the angular relationship between the second cut surfaces forming the bottom surfaces of the two cut bodies in FIG. 5 and the longitudinal axis of the workpiece and cut surfaces parallel thereto.

As best seen in FIG. 5A, the surfaces 36 and 38 are formed in the interior of the workpiece 10 in closely spaced, facing relationship to each other. As shown, the first and second portions have equal, but opposite, slopes such that the foamed plastic bodies 14 formed thereby have complementary profiles in vertically transverse cross-section. Thus the foamed plastic body 14 shown in the upper half of FIG. 5A has a height at its left end which is shorter than its height at its right end. Conversely the left end height of the body in the lower half of FIG. 5A is shorter than its right end half. Thus the taller end of the upper cut body is at the same end of the workpiece as the shorter end of the lower cut body. Because the bottom surfaces of the two form bodies also extend in closely spaced facing relationship along the axial length of the workpiece, the shorter end of the upper form body faces the taller end of the second form body. This allows generation of waste to be minimized at both ends of the workpiece.

Figure 12:
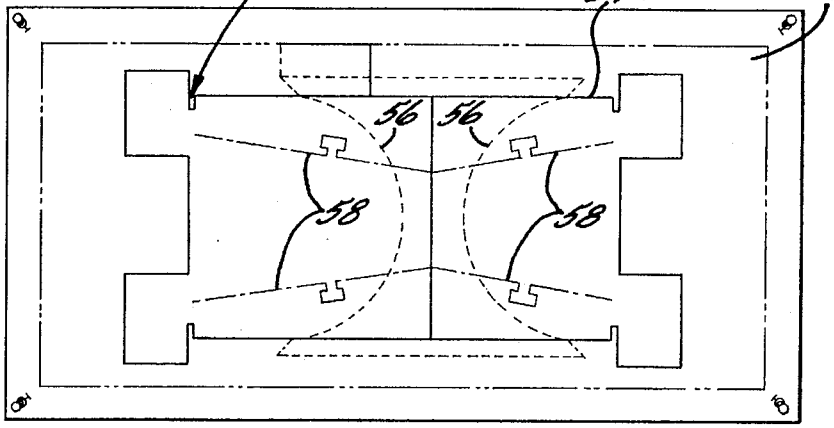
FIG. 12 is a plan view of a template carrying a predetermined pattern for producing foamed plastic bodies according to the present invention.

FIG. 12 illustrates a different cutting path wherein a single cut line 34 shown in transverse cross-section as a dashed line, separates or divides the first and second foamed plastic bodies 14 and defines the second surfaces 34 for both foamed plastic bodies 14. In this embodiment, the first surface 30, shown by a solid line, does not extend between the foamed plastic bodies 14 so as to separate or divide the bodies but, instead, only forms the exterior shape of the foamed plastic bodies 14. Thus as with the embodiment shown in FIG. 5A, the surfaces formed by the second cutting path 34 divide the first and second foamed plastic bodies 14 and form complementary surfaces on the cut foamed plastic bodies 14 formed from the workpiece 10.

Although the cutting step forming the complementary surfaces dividing the first and second foamed plastic bodies 14 is conducted after the workpiece 10 has been shifted in the embodiment illustrated in FIGS. 1–5A, and 12, it will be apparent that the cutting steps may be reversed without departing from the spirit and scope of the present invention. For example, the surface dividing or separating the first and second foamed plastic bodies 14 may be cut before the workpiece 10 is shifted. The remaining surface defining the exterior of the foamed plastic bodies 14 may then be cut after the workpiece 10 has been shifted.

As shown in FIG. 2, a third cutting step is preferably conducted on foamed plastic bodies 14 which comprise trench forms. The third cutting step is conducted to form a pair of longitudinally extending slots 40 in an interior portion of each complementary form body. The slots are formed by moving the linear cutting element 16 along path 39 through an interior portion of both the first and second bodies 14 as illustrated by the double arrow path of FIG. 2. The longitudinal slots 40 thus formed in the cut bodies extend upwardly from the bottom surface (36 and 38 FIG. 5) of each form body into an interior portion of the form body. The longitudinal slots 40 formed within the first and second cut bodies 14 are useful to facilitate the removal of trench forms following their use to produce a drainage trench. Such trench forms and the resulting drainage trench are discussed briefly hereinafter and are also described in detail in pending U.S. patent application Ser. No. 08/121,042, entitled "Method and Apparatus for Forming a Trench" by Lannie L. Stegall, the contents of which are hereby incorporated herein by reference.

As illustrated in FIG. 12, the longitudinally extending slots 40 formed by the third cutting step may each also define a fracturable locking member 57. The fracturable locking member 57 is integral with the truncated V-shaped wedge portion defined by the slots 40. In particular, the fracturable locking member 57 includes a head portion 63 joined to the truncated V-shaped wedge portion 70 by a neck portion 61. The neck portion 61 is relatively thin and will, accordingly, fracture upon assertion of a generally upward force to the truncated V-shaped wedge portion 70 during removal of the form body from a finished trench. However, the fracturable locking member 57 maintains the truncated V-shaped wedge portion 70 and the corresponding lateral portions 72 of the form body in an adjacent relationship during formation of a trench. Although the fracturable locking members 57 are illustrated as extending outwardly from the truncated V-shaped wedge portion 70 into the corresponding lateral portions 72, the fracturable locking members 57 may also be integral with and extend from the corresponding lateral portions 72 into the truncated V-shaped wedge portion 70.

The linear cutting element 16 may be controllably moved through the foamed plastic body 14 by any suitable control means and according to any method known to those skilled in the art. However, in one preferred embodiment the apparatus illustrated in FIG. 1 can be used in response to an automatic control system. FIG. 1 illustrates portions of one such control system which includes a set of instructions for controlling the movement of the linear cutting element 16. In one embodiment, the set of instructions includes a template 50 for controlling the movement of the linear cutting element 16 in response to a predetermined shape displayed by the template 50. The template is shown in detail in FIG. 11. With reference to FIG. 11, the template 50 displays, in transverse cross-section, the predetermined shape of the first and second foamed plastic bodies 14.

As is known to those skilled in the art, the template 50 is used in combination with an electronic eye or optical tracer 51 (FIG. 1), such as a Big Wally Electric Eye Cutter manufactured and distributed by Big W Industries Inc. in Kansas City, Kans. The electronic eye 51 electronically tracks the predetermined pattern displayed by the template 50. The electronic eye 51 is also operatively connected, via a computerized control system 52 or the like, for controlling the movement of the linear cutting element 16 via the first and second support members 18 and the vertical arms 19, to move the linear cutting element 16 in response to the predetermined pattern displayed by the template 50.

Figure 13:
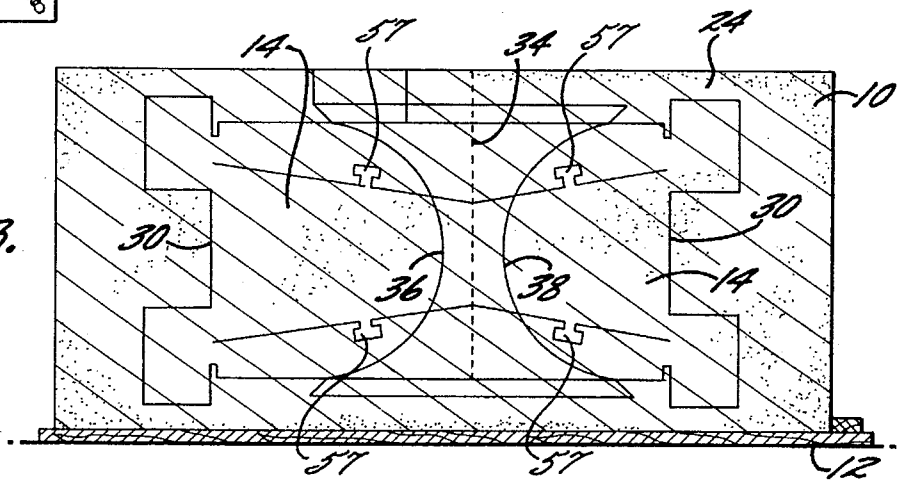
FIG. 13 is a lateral cross-sectional view of a workpiece illustrating the complementary matching form bodies produced by moving the linear cutting element according to the predetermined pattern of the template of FIG. 12.

With the template of FIG. 12, the linear cutting element 16 is moved through the workpiece 10 in response to a first portion 54 of the predetermined pattern displayed by a template 50, shown by a solid line in FIG. 12, to form the first cut surface 30. Following a shift in position of the workpiece 10 relative to both the linear cutting element 16 and the cutting table 12, the linear cutting element 16 is again moved through the workpiece 10 in response to a second portion 56 of the predetermined pattern displayed by the template 50, shown with a dashed line in FIG. 12, to form the second or bottom surfaces 34 of the first and second complementary foamed plastic bodies 14. The predetermined pattern displayed by the template 50 may also include a third portion 58 shown as a dotted and dashed line in FIG. 12, in response to which the linear cutting element 16 moves through the workpiece 10 to form a third surface defining pairs of diverging slots 40 extending through the interior of the complementary foamed plastic bodies 14. Accordingly, first and second foamed plastic bodies, as illustrated in cross-section in FIG. 13, may be formed by employing the template 50 of FIG. 12 to guide the linear cutting element 16.

Other control systems instead of the template system discussed above, can also be used in the cutting method of the invention. Thus, for example, the movement of the linear cutting element 16 can be controlled by a CAD CAM (computer aided design computer aided manufacture) system, which, for example, may move the linear cutting element 16 in response to a predetermined set of instructions defining a pattern stored as a file in volatile or non-volatile memory of the computer. Alternatively, other methods of controllably moving the linear cutting element 16 to cut a foamed plastic workpiece 10 will be known to those skilled in the art and may also be utilized without departing from the spirit and scope of the present invention.

In a preferred embodiment of the invention, a plurality of foamed plastic bodies are provided as an set for defining the shape of a trench, such as a drainage trench. The formation of such drainage trenches is discussed below and described in greater detail in the previously mentioned U.S. patent application Ser. No. 08/121,042, entitled "Method and Apparatus for Forming a Trench" to Lannie L. Stegall.

Figure 10:
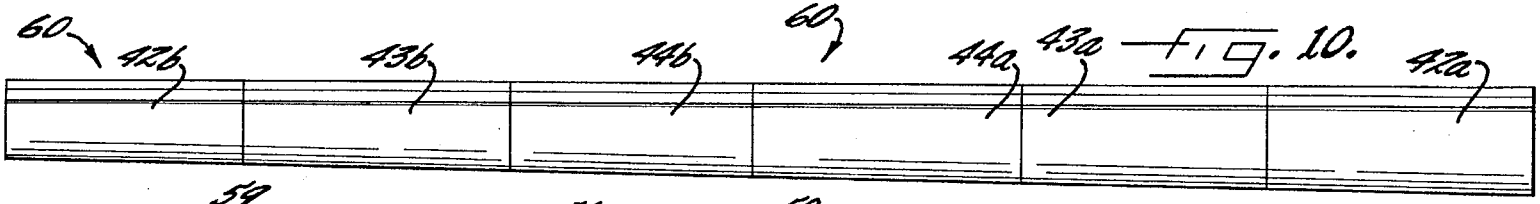
FIG. 10 is a side view of a set of six trench forms illustrating the continuously sloped bottom surface of the forms.
Figure 11B:
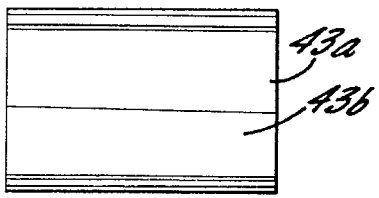
FIGS. 11*a*–11*c* illustrate complementary pairs of form bodies of the present invention which can be assembled into a drainage form assembly as illustrated in FIG. 10.
Figure 11A:
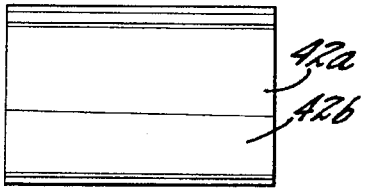
Figure 11C:
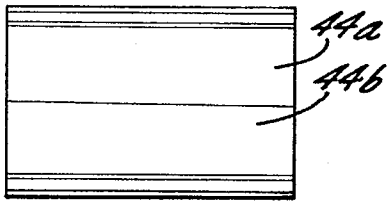

FIG. 10 illustrates assembly 60 formed from a plurality of axially aligned trench form bodies **42*a*–44*b* of FIGS. 11*a*, 11*b*, and 11*c*, which in turn, each illustrate a pair of complementary matching form bodies cut according to the patterns illustrated in FIGS. 5 and 5A. As best seen in FIG. 5A, the slope of the cuts that define the bottom surfaces 36 and 38 of both of the form bodies 14 from the workpiece 10 are equal. By forming the complementary bottom surfaces at different lateral locations in pairs of trench form bodies as illustrated in FIGS. 11*a*, 11*b*, and 11*c*, a plurality of such trench forms 42*a*, 42*b*, 43*a*, 43*b*, 44*a*, and 44*b*, of varying heights and identically sloping bottom surfaces can be fabricated according to the invention. An assembly 60 of the six trench forms 42*a*–44*b* abutted in an end-to-end relationship such that the height of the assembly continuously increases along its length, is illustrated in FIG. 10. The use of assembly 60 of FIG. 10 for forming an elongate drainage trench is illustrated in FIGS. 6 and 10**.

Figure 6:
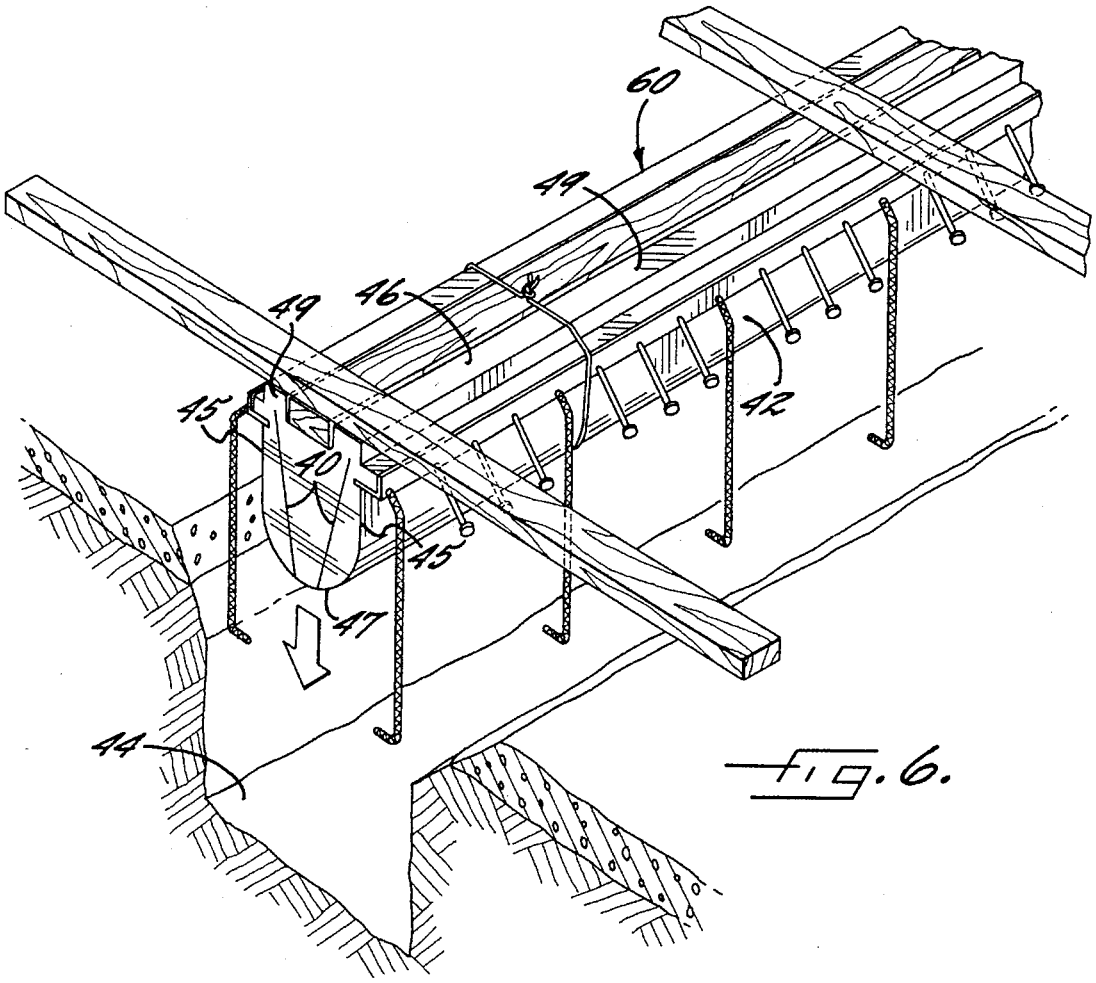
FIG. 6 is a perspective view illustrating the installation of a drainage trench form assembly produced by assembling a plurality of form bodies cut according to the present invention.

In FIG. 6 the assembly 60 of trench form bodies **42*a*–44*b* abutted at their end faces is shown being placed within a preformed ditch 44 for shaping a hardenable trench forming composition which is thereafter poured about the assembly of the form bodies 60. The assembly 60 of form bodies includes opposed side surfaces 45 and a top surface 46 formed by the corresponding matching side and bottom cut surfaces of each of the form bodies 42*a*–44*b*. Thus, the cut surfaces formed in each of the form bodies 42 by the cutting path 30 in FIG. 2 are matching so that the sidewall of the assembled form is continuous. Likewise, the bottom surfaces of the form bodies resulting from the cutting path 34 of FIG. 5 cooperate to form a continuously sloping surface 47 along the assembly 60**.

Figure 9:
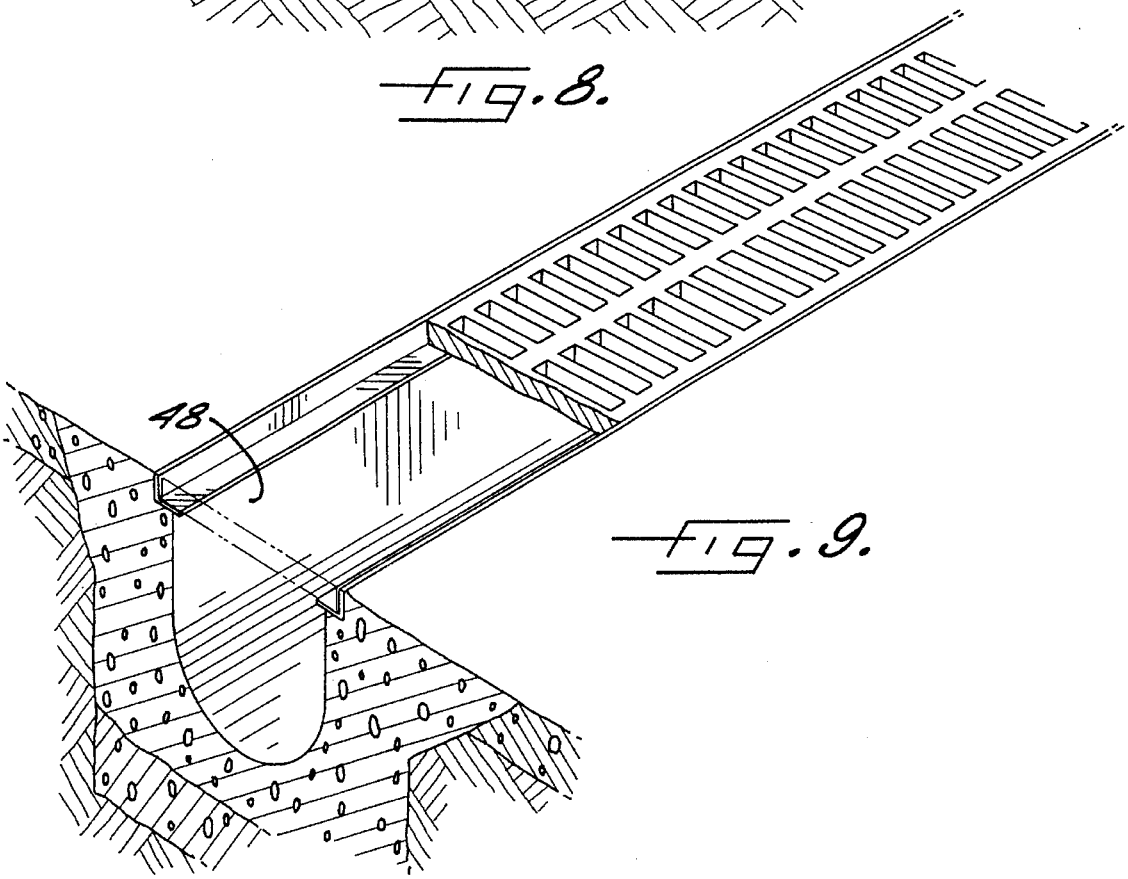
FIG. 9 is a perspective view of the resulting drainage trench.

The assembly 60 of form bodies is used in combination with a pair of rail members 54 having anchoring legs 56 attached thereto (FIG. 6). In particular, an elongate slot 59 may be defined in each of the opposed side surfaces of the form bodies. As shown in FIG. 6, the elongate slots 59 are adapted to receive and engage rail members 54. This assembly is placed within a trench typically formed in the earth, and a hardenable material such as concrete is poured around the exterior thereof and allowed to harden. Following hardening of concrete or like hardenable material poured around the assembly 60, a drainage trench 48 having continuous side walls and a sloped bottom surface corresponding to the side and sloped bottom surfaces of assembly 60 is provided as illustrated in FIG. 9.

Figure 7:
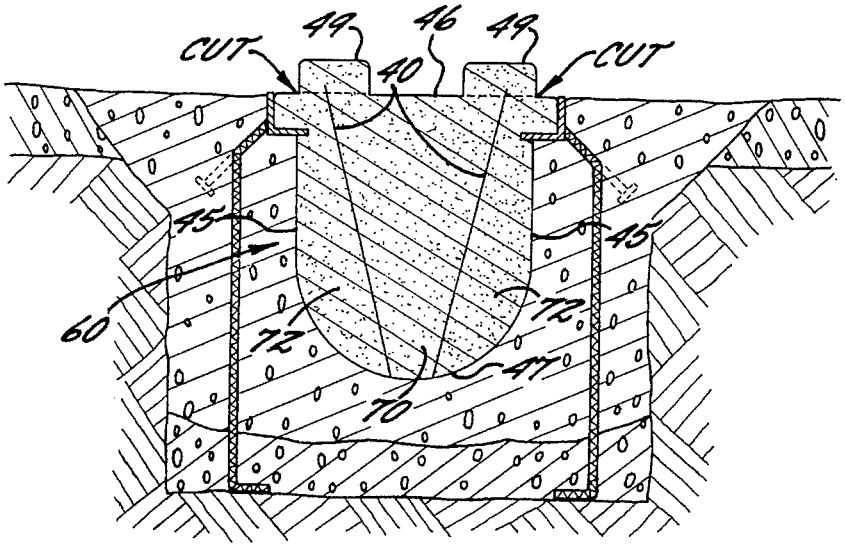
FIG. 7 is a lateral cross-sectional view of the drainage trench form as installed in a ditch.

As illustrated in FIGS. 7, the top surface 46 includes ear portions 49 which extend above a lower portion of the top surface 46. A portion of the ear portions 49 may be severed to expose longitudinal slots 40 extending through the assembly 60. For example, a portion of the ear portions 49 may be severed by cutting, such as with a radial saw, from the top surface 46 through the interior of the form body to the longitudinal slots 40. Alternatively, the ear portions 49 may be severed, such as by scraping the top surface 46 of the form body with a shovel, to expose the longitudinal slots.

Figure 8:
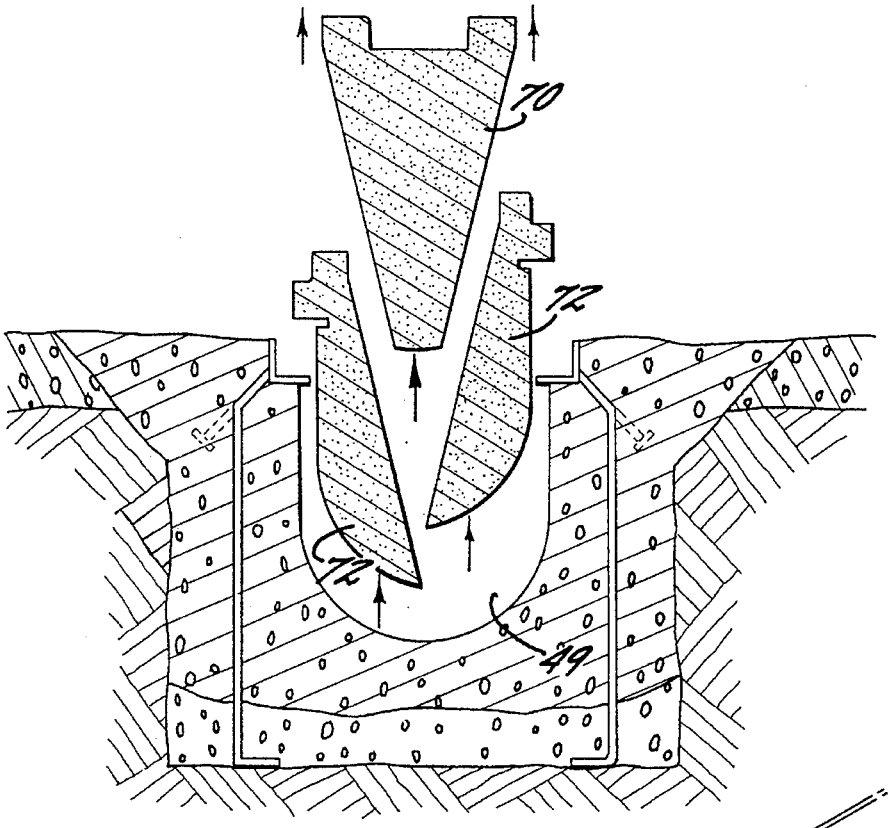
FIG. 8 is a lateral cross-sectional view illustrating the removal of the form from the drainage trench.

The center and lateral portions of the trench form assembly 60 are thereafter removed as shown in FIG. 8 to produce a drainage trench 48.

The set of form bodies formed by matching complementary pairs of form bodies as illustrated in FIGS. 11*a–c* and 10, allows the stocking of sets of separate form bodies that can be used to produce trench drains of various heights and lengths. As seen in FIG. 10, each of the form bodies 42*a*–44*b* has a substantially identical length. As seen from the assembly 60 shown in FIG. 6, each of the form bodies 42*a*–44*b* has a substantially identical width, and the profiles of the sidewall surfaces are substantially matching. Each of the form bodies 42*a*–44*b* also has correspondingly sloped bottom surfaces such that the longitudinal profile of each form body is taller at one end and shorter at the other. The end profiles of each of the form bodies vary in height from a predetermined tallest height, the height of form body 42*a*, to a predetermined shortest height, the height of form body 42*b*. With the exception of the tallest and the shortest end profiles 42*a* and 42*b*, the end profile of each form body is substantially matching in height with an end profile on another form body as best seen in FIG. 10. As seen in FIGS. 11*a*–11*c*, the heights of each of the taller and shorter end profiles, respectively, on each form body are complementary to the heights of the shorter and taller end profiles, respectively, of another of the form bodies such that the sums of the heights of all of the complementary end profiles are the same.

The set of form bodies shown in FIGS. 11*a–c* and 10, can be used to provide a retail supply of standard sized form bodies that can be assembled to form drainage trenches of varying overall lengths. For example when a relatively short, shallow drainage trench is needed, a customer can purchase form bodies 42*b*, 43*b*, and 44*b*. Similarly, when a relatively short, deep drainage trench is needed, a customer can purchase form bodies 42*a*, 43*a*, and 44*a*. However a complete set of the form bodies can be purchased to form a longer drain having a sloping surface. A complete stock of the form bodies will normally include several complete sets of the form bodies. Moreover sets of form bodies of different widths can be stocked to allow formation of drainage trenches of varying widths. The retailer can reorder complete sets of the form bodies or only partial form body sets. In either case the form bodies of one set of standard length and width form bodies can be used with form bodies from another set of the same standard form bodies to form short or long drains with sloping surfaces. Although form body sets of varying lengths can be used in the invention, a preferred set of form bodies comprising individual forms each having a length of from about 4 feet to about 12 feet, heights ranging from about 8 inches to about 48 inches, slopes of from about 1/16 inch per foot to about 1/4 inch per foot, and a complete set of form bodies will normally have up to about 20 individual bodies. More preferably, a set of form bodies comprises individual forms each having a length of about 8 feet, heights ranging from about 8 inches to about 30 inches, and slopes of about 1/8 inch per linear foot.

In another advantageous embodiment of the invention, multiple foamed plastic bodies 14, such as two trench forms 42*a–b*, are cut from a single workpiece 10 so as to minimize the amount of scrap 24 generated. The scrap 24 remaining once the first and second complementary foamed plastic bodies 14 have been cut extends about and envelops the first and second foamed plastic bodies 14 as illustrated in FIGS. 2, 5 and 12. Therefore, the thus-formed foamed plastic bodies 14 may be packaged and shipped with the scrap 24 remaining thereabout to protect the foamed plastic bodies 14 during shipment. The packaging and shipment of the complementary foamed plastic bodies 14 and their associated scrap 24 provides a relatively convenient, rectangular solid package for shipment.

Although the method and products of the invention have been described with reference to drainage trench form bodies of preferred designs, it is to be understood that the invention is applicable to drainage form bodies of various designs and shapes and also to provide sets of foamed plastic bodies for other uses and products such as for forming artificially sloped sports surfaces, roofing surfaces, and the like.

In the drawings and the specification, there has been set forth a preferred embodiment of the invention and, although specific terms are employed, the terms are used in a generic and descriptive sense only and not for purpose of limitation. It will thus be apparent that numerous variations can be made within the spirit and scope of the invention as described in the foregoing specification and defined in the following claims.

That which is claimed is:

1. A plurality of sets of foamed plastic form bodies, each set of foamed plastic form bodies comprising:

a plurality of elongate form bodies of predetermined shapes adapted for assembly into an elongate drain form, each elongate form body having a top surface and an opposed bottom surface, each elongate form body also having a substantially identical length and width and substantially matching sidewall surfaces in profile;

each elongate form body having been cut from a portion of a foamed plastic workpiece as one of a pair of complementary shaped and sized form bodies cut from the foamed plastic workpiece, each elongate form body having an equally sloped bottom surface relative to the respective top surface;

each of the elongate form bodies also having correspondingly sloped bottom surfaces such that the longitudinal profile of each form body is taller at one end and shorter at the other and wherein the collective end profiles of the set of form bodies vary in height from a predetermined tallest height to a predetermined shortest height, and, with the exception of the tallest and the shortest end profiles, each end profile is substantially matching in height with an end profile on another form body; and wherein the heights of each of the taller and shorter end profiles, respectively, on each form body are complementary to the heights of the shorter and taller end profiles, respectively, of another of the form bodies of the plurality of sets of form bodies such that the sums of the heights of all of the complementary end profiles are substantially the same.

2. The plurality of foamed plastic form bodies comprising at least one set of foamed plastic form bodies according to claim 1 wherein said set of foamed plastic form bodies comprises six form bodies of predetermined shapes adapted for assembly into an elongate drain form.

3. A plurality of sets of foamed plastic form bodies according to claim 1 wherein each pair of complimentary shaped and sized form bodies are cut from the interior of the foamed plastic workpiece such that each pair of complimentary shaped and sized form bodies is at least partially surrounded by scrap portions of the foamed plastic workpiece which provide protection during shipment and storage of said form bodies.

4. A plurality of sets of foamed plastic form bodies according to claim 1 wherein each elongate form body defines a pair of slots extending inwardly into the foamed plastic form body from the bottom surface thereof.

* * * * *

UNITED STATES PATENT AND TRADEMARK OFFICE

CERTIFICATE OF CORRECTION

PATENT NO. : 5,573,350

DATED : November 12, 1996

INVENTOR(S) : Lannie L. Stegall

It is certified that error appears in the above-identified patent and that said Letters Patent is hereby corrected as shown below:

On the cover page, Column 1, U.S. Patent References, insert --5,326,190 7/1974 Beamer--.

On the cover page, Column 2, Other Publications, line 3, delete "Multi/Drain" and insert --MultiDrain-- therefor.

Column 2, line 30, delete "proceses" and insert --process-- therefor.

Column 3, line 29, delete "that" and insert --than-- therefor.

Column 5, lines 52, 55 and 63, delete "be" and insert --10-- therefor.

Column 6, line 24 delete "of" (second occurrence).

Column 6, line 45, delete "in" (first occurrence).

Column 6, line 52, after "surface" insert --30--.

Column 8, line 44, after "38" insert --of--.

Column 10, line 5, delete "an" and insert --a-- therefor.

UNITED STATES PATENT AND TRADEMARK OFFICE

CERTIFICATE OF CORRECTION

PATENT NO. : 5,573,350

DATED : November 12, 1996

INVENTOR(S) : Lannie L. Stegall

It is certified that error appears in the above-identified patent and that said Letters Patent is hereby corrected as shown below:

Column 12, line 50, delete "one set" and insert --two sets-- therefor.

Column 12, line 51, delete "said" and insert --each-- therefor.

Column 12, lines 55 and 57-58, delete "complimentary" and insert --complementary--

Signed and Sealed this

Fifth Day of August, 1997

Bruce Lehman

*Attest:*

BRUCE LEHMAN

*Attesting Officer*

*Commissioner of Patents and Trademarks*